United States Patent [19]

Silverman

[11] Patent Number: 4,763,445

[45] Date of Patent: Aug. 16, 1988

[54] COMBINED SLIDE GUIDE AND PIVOT PIN FOR SASH WINDOW

[75] Inventor: Arthur Silverman, Florham Park, N.J.

[73] Assignee: Silver Line Building Products Corporation, Middlesex, N.J.

[21] Appl. No.: 937,373

[22] Filed: Dec. 3, 1986

[51] Int. Cl.[4] ..... E05D 15/22

[52] U.S. Cl. ..... 49/176; 49/185

[58] Field of Search ..... 49/430, 176, 181, 184, 49/185

[56] References Cited

U.S. PATENT DOCUMENTS

| | | | |
|---|---|---|---|
| 3,959,926 | 6/1976 | Noecker et al. | 49/181 |
| 4,028,849 | 6/1977 | Anderson | 49/181 |
| 4,115,973 | 9/1978 | Anderson | 49/181 X |
| 4,144,674 | 3/1979 | Dovman | 49/417 |
| 4,363,190 | 12/1982 | Anderson | 49/181 |
| 4,364,199 | 12/1982 | Johnson et al. | 49/181 |
| 4,506,478 | 3/1985 | Anderson | 49/181 |
| 4,555,868 | 12/1985 | Mancuso | 49/181 |
| 4,570,382 | 2/1986 | Suess | 49/430 |
| 4,581,850 | 4/1986 | Simpson | 49/181 |
| 4,590,708 | 5/1986 | Campodonico | 49/181 |

*Primary Examiner*—Philip C. Kannan

*Attorney, Agent, or Firm*—Lerner, David, Littenberg, Krumholz & Mentlik

[57] ABSTRACT

A combined slide guide and pivot pin for engaging the sash balance of a double-hung window assembly, and for riding in a guide rail of the master frame jamb of the window assembly to retain the guide rail in alignment relative to the sash window when the window is slided, utilizes a unitary metal member having, at a first end, a notched upper surface adapted to engage the sash balance, and having a cross-bar, as a slide guide, disposed proximate the first end with bevelled upper and lower surfaces.

10 Claims, 2 Drawing Sheets

COMBINED SLIDE GUIDE AND PIVOT PIN FOR SASH WINDOW

FIELD OF THE INVENTION

The present invention relates generally to the pivotal sash window of double-hung window assemblies, and more particularly, to a unitary slide guide and pivot pin adapted to be installed with a pivot corner member inside a bottom corner of the window sash frame, with the guide and pivot pin extending laterally outward from the proximate stile of the sash window frame for engaging, respectively, the guide rail of the master frame jamb, and the sash balance of the window assembly.

BACKGROUND OF THE INVENTION

Double-hung window assemblies provide for selective pivoting of each window sash by means of a slide guide and pivot pin. The slide guide extends laterally outward from the bottom of each stile of the sash window frame, and engages flanges of a channel-shaped guide rail in the proximate vertical jamb of the window assembly. The pivot pin engages a sash balance assembly disposed in the channel-shaped guide rail of the vertical jamb. The slide guide is generally T-shaped, and rides behind the outermost flanges of the channel-shaped guide rail to maintain the desired parallel relationship between the stiles of the sash frame and the guide rails of the master window jambs during assembly and sliding movement of the window sash relative to the jambs.

Conventionally, a slide guide has been attached to the bottom of the sash window frame, via a screw, and a separate pivot pin has been inserted into the vertical stile proximate the slide guide. The pivot pin is seated on a pivot corner member disposed within the bottom corner of the sash window frame. In U.S. Pat. No. 4,581,850 by Simpson, issued Apr. 15, 1986, entitled "Combination Pivot Corner and Slide Guide for Sash Window", the slide guide and the pivot corner member are unitary, and a separate pivot pin is inserted thereinto. This results in the requirement that the slide guide and pivot corner member be constructed of the same material. Also, the slide guide and the pivot pin are separate members.

SUMMARY OF THE INVENTION

The present invention entails a window assembly, comprising a channel-shaped guide rail having opposed inwardly directed flanges defining an open therebetween; a sash balance assembly disposed within the guide rail; a window sash assembly disposed adjacent the guide rail, the window sash assembly comprising a vertical stile including a passage at a bottom corner thereof aligned with the guide rail opening; and a slide guide and pivot pin apparatus comprising a unitary member having: a first end; a second end, disposed opposite the first end, adapted to engage the sash balance assembly and function as a pivot pin; and slide guide means, disposed between the first and second ends, for engaging the flanges to retain the window sash and guide rail in substantially parallel relationship during sliding movement of the window sash relative to the guide rail.

In a preferred embodiment of the window assembly of the present invention, the slide guide means comprises a cross-bar having surfaces facing, respectively, the first and second ends of the unitary member which are substantially perpendicular to an axis of the member extending from the first to the second end. The upper surface of the cross-bar is bevelled downwardly towards the first end, and the lower surface of the cross-bar is bevelled upwardly towards the first end. The upper surface of the unitary member at the first end comprises a slot for engaging the sash balance. A screw hole is disposed vertically through the member between the first end and the cross-bar. The unitary member is die cast from zinc.

In another preferred embodiment of the present invention, the window assembly further comprises a body having a bottom end; a passageway through the bottom end opening toward an upper end of the body; a ledge spaced above the bottom end; and, a longitudinal opening communicating with the ledge, adapted to receive the unitary member therethrough supported on the ledge with the slide guide means extending from the body.

The present invention further entails a slide guide and pivot pin apparatus adpated to be installed inside a bottom corner of a window sash frame of a window assembly which provides a vertical jamb having a channel-shaped guide rail opening toward a vertical stile of the window sash frame, the channel-shaped guide rail having opposed inwardly directed flanges defining an opening therebetween, and a sash balance assembly within the guide rail, the vertical stile including a passage at a bottom corner thereof aligned with the guide rail opening, the slide guide and pivot pin apparatus comprising an elongated member and a transverse portion disposed substantially perpendicular to the elongated member, and wherein one end of the elongated member serves as the pivot pin and the transverse portion serves as the slide guide.

In a preferred embodiment of the slide guide and pivot pin apparatus of the present invention, the transverse portion is disposed adjacent to the end which serves as the pivot pin.

The present invention eliminates the need for separate slide guide and pivot pin components. As such, the present invention facilitates design and assembly of double-hung windows. Further, the simplification inherent in the present invention enhances the operability and reliability of such windows.

In this regard, the prior art requirement for separate pivot pin and slide guide members results in a greater possibility of binding due to interaction between these members and between these members and the guide rail flanges. Thus, the fact that they are separate members results in relative movement which, in connection with their concurrent movement in the guide channels, can cause undesirable jamming or binding.

An additional advantage of the present invention with respect to the Simpson patent is that the present invention provides the advantage of an integral slide guide and pivot pin which may be made of a durable material such as metal, while retaining the advantage of permitting the construction of total plastic supporting members and the cost advantages attendant thereto. In this regard, the slide guide and pivot pin members are the ones which bear the maximum stress and are thus subject to similar constructional requirements.

The bevels on the slide guide portion of the present invention facilitate installation of the present invention behind the outermost flanges of the channel-shaped guide rail. The combined slide guide and pivot pin member of the present invention is installed in the channel-shaped guide rail by horizontally disposing the longitudinal axis of the member, by disposing the longitudinal axis of the cross-bar at an angle to the horizontal, and by pushing the member into the sash balance assembly in the guide rail while simultaneously twisting the cross-bar behind the outermost flanges of the guide rail. The bevels on the slide guide portion of the member ride behind the outermost flanges of the guide rail with twisting of the member, thereby facilitating insertion of the member into the guide rail.

The prior art including Simpson does not disclose a slide guide having a bevel. The slide guides of the prior art are blunt, and, accordingly, compound the difficulties of installing the slide guide behind the outermost flanges of the guide rail. Specifically, when the slide guides of the prior art are pushed towards the guide rail and twisted, their blunt edges catch on the outermost flanges, thereby resisting a twisting motion necessary to "screw" the slide guide behind the outermost flanges of the guide rail. The bevels disposed on the slide guide portion of the present invention overcome this difficulty by providing inclined surfaces which, when brought in contact with the outermost flanges, create relatively little resistance to twisting, and serve to direct the slide guide easily behind the outermost flanges.

In window assemblies, the vertical jamb having a channel-shaped guide rail tends to bow relative to the vertical stile of the window sash frame. A preferred embodiment of the present invention comprising metal resists this bowing by retaining the guide rail in parallel relationship with the vertical stile. This is a known desired function of slide guides and is one reason why slide guides have higher structural stress requirements than do support members.

The apparatus disclosed in Simpson is made of plastic and is thus both relatively weak and relatively flexible. In practice, the slide guide portion of the Simpson apparatus does not function as well as the present invention to preclude bowing of the guide rail relative to the vertical stile of the window sash. It tends to bow with it. That is, the arms of the slide guide portion of Simpson are not sufficiently rigid to retain the guide rail in parallel relationship with the vertical stile. In addition, and more importantly, Simpson slide guide portions often break.

DESCRIPTION OF THE PREFERRED EMBODIMENTS

Figure 1:
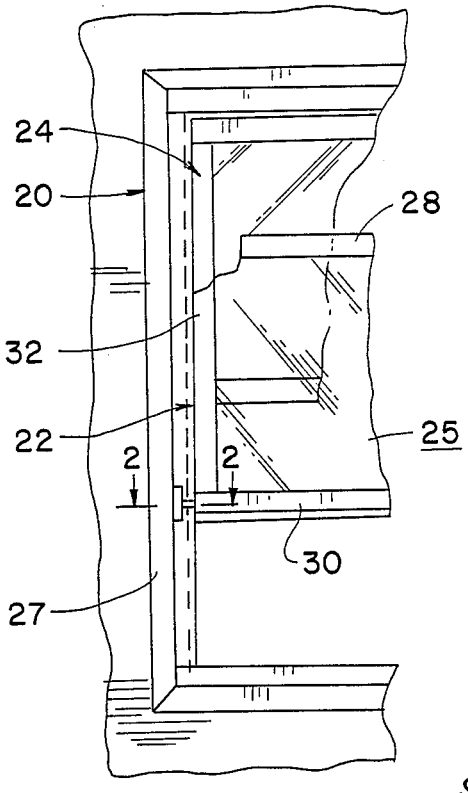
FIG. 1 is a fragmentary front elevational view of a double-hung window assembly having the combined slide guide and pivot pin embodying the present invention shown in broken outline installed in a sash window.

FIG. 1 illustrates partially a representative window of the double-hung window sash assembly. Such assembly includes a main jamb frame 20 within which is slidably mounted a pair of double-hung sashes 22 and 24 fitted with suitable glazing 25. Both the frame 20 and sashes 22 and 24 can be formed of several different materials, such as, metal or strong and rigid plastic materials well-known in this field. For purposes of this invention, the sashes 22 and 24 are pivotal relative to the frame 20 to permit cleaning and other required maintenance thereof.

The master frame 20 and sashes 22 and 24 are fabricated from elongate framing members, preferably of hollow configuration and transverse cross-section for well-known reasons of economy, weight and thermal insulation advantages. The exact construction of the master frame 20 is not critical for achieving the advantages of the present invention. The vertical structural members of the master frame 20 will include sash balances designed to cooperate with pivot pins installed on the sashes 22 and 24 to permit desired pivotal movement of the sashes relative to the master frame. Further, these vertical structural members of the frame 20 contain guide rails. A typical guide rail is designated 26 in FIG. 2, and includes flanges 38.

Figure 3:
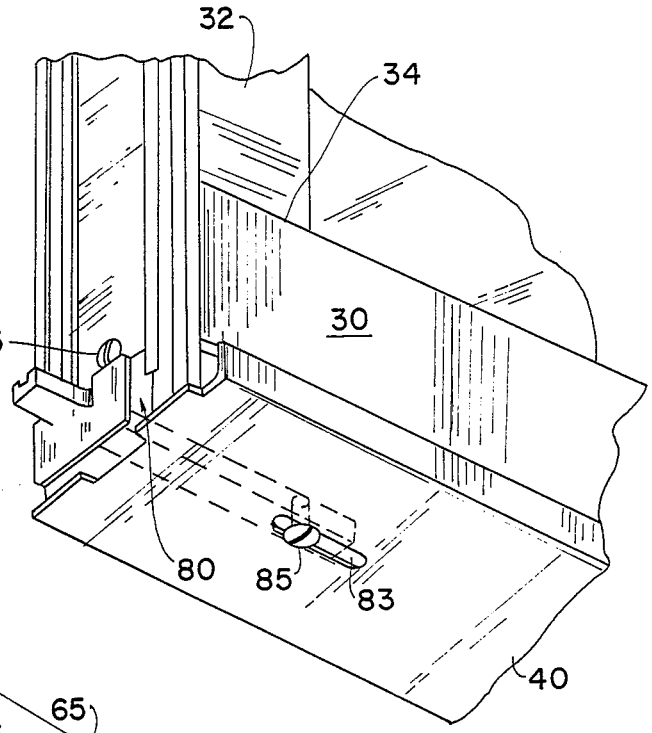
FIG. 3 is a fragmentary perspective view of a bottom corner of a sash window to illustrate installation of the present invention in the sash window frame.

Referring to FIGS. 1 and 3, sash frame 22 is generally rectilinear in configuration and is comprised of a top header 28, a base 30 and a pair of side members or stiles one of which is illustrated at 32. The stiles or side members 32 are joined at their extremities to contiguous extremities of the header 28 and base 30, as seen generally at 34, to provide the sash frame of desired size and configuration. The jointed corners of the sash are maintained by suitable fasteners such as a screw 45. The upper sash 24 is of similar construction. For purposes of the present invention, the base 30 is hollow, but its exact cross-sectional configuration may vary within wide limits. The sash 22 and the sash 24 are preferably each formed from extruded plastic frame members.

Figure 5:
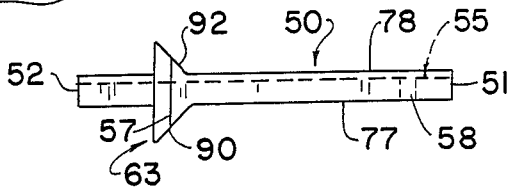
FIG. 5 is a side elevational view of the combined slide guide and pivot pin of the present invention.
Figure 2:
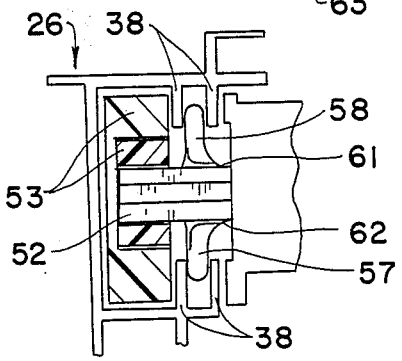
FIG. 2 is a fragmentaray sectional view taken along the line 2—2 of FIG. 1 to illustrate the engagement of the combined slide guide and pivot pin of the present invention with the flanges of the guide rail of the master frame jamb, and the sash balance assembly disposed in the guide rail.
Figure 4:
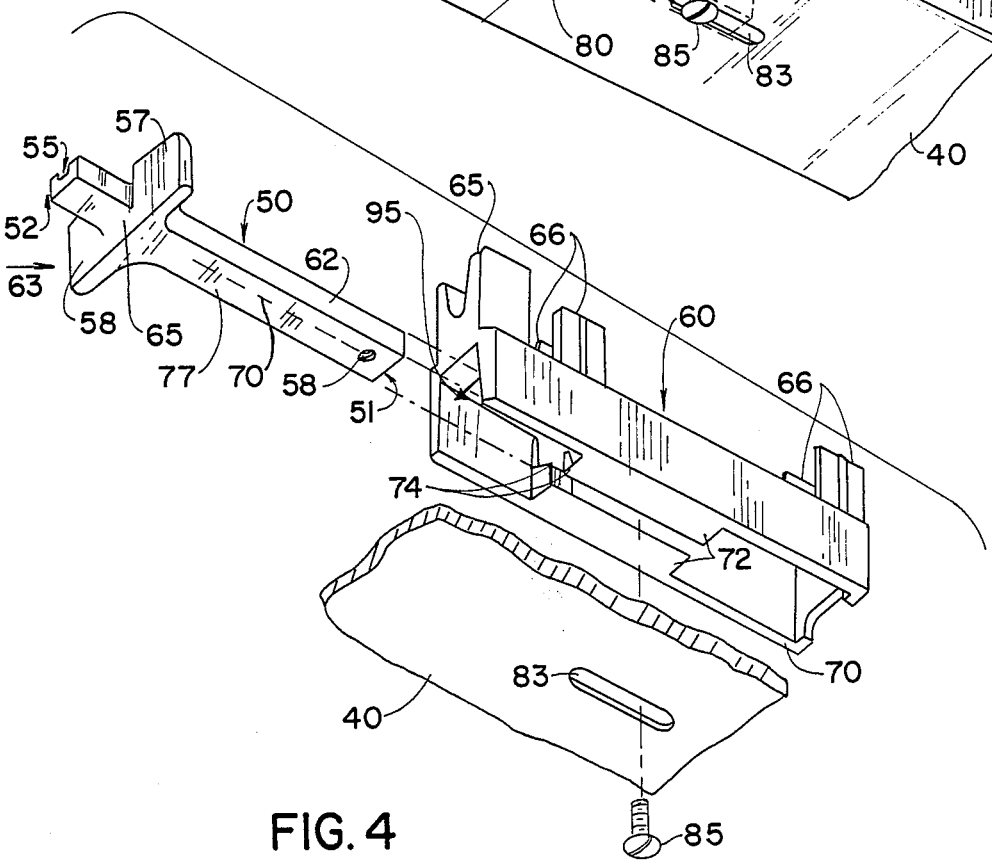
FIG. 4 is an exploded perspective view of the installation in FIG. 3 depicting the combined slide guide and pivot pin of the present invention and a pivot corner member into which it is inserted.

Referring to FIGS. 2 and 4, a combined slide guide and pivot pin 50 is depicted. The member 50 is unitary in character, that is, consists of a single piece, rather than the multiplicity of pieces of the prior art. The member 50 comprises a first end 51, and a second end 52 adapted to engage a sash balance assembly 53. In a preferred embodiment, the member 50 comprises metal, and is preferably die cast from zinc. Of course, the guide portion comprising the arms 57 and 58 could be rigidly attached to the remainder of the member 50 by welding, fastening means, etc. Preferably, the upper surface of the member 50, at the second end 52, comprises a slot 55 for engaging a projection on the sash balance assembly 53. Arms 57 and 58 outwardly from, respectively, a side 62 and a side 61 of the member 50. The arms 57 and 58 are adapted for sliding between the flanges 38 in order to retain the window sash and jamb in substantially parallel relationship during assembly and sliding movement of the window sash relative to the jamb. Preferably, the arms 57 and 58 form a cross-bar 63 having a surface 65 and a surface opposite thereto (not shown) which are both substantially perpendicular to a longitudinal axis 70 of the member 50. Referring to FIG. 5, preferably, the cross-bar 63 extends vertically from above an upper surface 78 of the member 50, to below a lower surface 77 of the member 50.

Referring to FIG. 5, preferably a lower surface of the arms 57 and 58 comprises a bevel 90. The bevel 90 is preferably inclined upwardly towards the first end 51 of the member 50. Similarly, the upper surface of the arms 57 and 58 preferably comprises a bevel 92. The bevel 92 is preferably inclined downwardly towards the first end of the member 50. The bevels 90 and 92 facilitate installation of the arms 57 and 58 into the guide rail 26, behind the outermost of the flanges 38. A screw hole 58 is disposed vertically through the member 50 between the cross-bar 63 and the first end 51. Preferably, the member 50 comprises metal, and is most desirably die cast from zinc. Preferably, the slot 55 extends from the first end to the second end of the member 50.

Referring to FIG. 4, a pivot corner member 60 comprises vertical guides 66, and a projection 65 having a screw hole (not shown) disposed horizontally therethrough for engaging the screw 45 of FIG. 3. The pivot corner member 60 opens upwardly from the bottom end 70, and is provided with a pair of spaced apart upstanding abutments 72 having notches at 74 to provide ledges for accommodating the combined slide guide and pivot pin 50.

The first end 51 of member 50 is inserted into a longitudinal opening 95 of the pivot corner member 60 so that the lower surface 77 of the member 50 rests on the ledges of the abutments 72, and the arms 57 and 58 extend from the member 60.

Referring also to FIG. 3, the members 50 and 60 may be installed inside the bottom corner of the window sash frame by removing, if possible, a bottom 40, and placing the members 50 and 60 into the interior of the base 30 so that the arms 57 and 58 of the member 50 extend out of an opening 80 in the stile 32. A screw 85 is inserted through an elongated opening 83 in the bottom 40, and passes between the abutments 72 of the member 60 into the opening 58 of the member 50, thereby fixing the members 50 and 60 in the bottom corner of the window sash. By positioning the screw 85 in the elongated opening 83, the distance which the member 50 extends through the opening 80 of the stile 32 may be adjusted. If the bottom 40 is not removable from the base 30, the members 50 and 60 may be installed in the bottom corner of the window sash frame by uncoupling the stile 32 from the base 30, via the screw 45, and inserting the members 50 and 60 into the base 30. The members 50 and 60 are fixed in place and positioned via the screw 85 inserted through the elongated opening 83, as before. The stile 32 is then recoupled, via the screw 45, to the base member 30.

In the case of either a removable or non-removable bottom 40, the screw 45 may also be inserted through the screw hole in the projection 65 of the member 60 to further fix the members 50 and 60 in place.

Referring to FIGS. 2 and 3, with the members 50 and 60 installed in the bottom corner of the window sash frame, the second end 52 of the member 50 may be inserted into the sash balance 53, and the combination inserted into the guide rail 26 so that the arms 57 and 58 of the member 50 are in register with the flanges 38.

Referring to FIG. 1, in this fashion, the window sashes 22 and 24 are retained in parallel, pivotable alignment with the master frame 20.

While the invention has been described in its preferred embodiments, it is to be understood that the words which have been used are words of description rather than limitation, and that changes within the purview of the appended claims may be made without departing from the true scope and spirit of the invention in its broader aspects.

We claim:

1. A window assembly comprising:

a channel-shaped guide rail having opposed inwardly directed flanges defining an opening therebetween;

a sash balance assembly disposed within said guide rail;

a window sash assembly disposed adjacent said guide rail, said window sash assembly comprising a vertical stile including a passage at a bottom corner thereof aligned with said guider rail opening; and a corner assembly comprising a corner member and a combination slide guide and pivot pin member constructed to cooperate with said corner member, said corner assembly being constructed to be installed in said bottom corner of said window sash assembly, said corner member comprising a unitary body having a bottom end and a passageway through said bottom end opening toward an upper end of said body, and at least one ledge spaced above said bottom end;

said unitary body having a longitudinal opening communicating with said at least one ledge and adapted to receive said combination slide guide and pivot pin member therethrough so that said combination slide guide and pivot pin member is supported on said at least one ledge, said combination slide guide and pivot pin member being elongated and comprising a first end;

a second end, disposed opposite and first end, engaging said sash balance assembly and functioning as a pivot pin; and slide guide means, disposed between said first and second ends, for engaging said flanges to retain said window sash assembly and said guide rail in substantially parallel relationship during sliding movement of said window sash assembly relative to said guide rail, said slide guide means comprising a first arm disposed on a first side of said combination slide guide and pivot pin member and a second arm, aligned with said first arm, disposed on a second side of said combination slide guide and pivot pin member, said first and second arms forming a cross-bar;

and wherein said corner assembly, when installed in said bottom corner of said window sash assembly, at least partially forms said bottom corner and facilitates sliding of said window sash assembly within said guide rail and pivoting of said window sash assembly about said sash balance assembly.

2. The window assembly of claim 1 wherein said second end of said combination slide guide and pivot pin member comprises a slot for engaging a corresponding receptacle located in said sash balance assembly.

3. The window assembly of claim 1 wherein said bottom corner further comprises an elongated opening and wherein a screw hole is disposed vertically through said combination slide guide and pivot pin member such that a screw inserted through said elongated opening and passing through said screw hole fixes said corner assembly in said bottom corner and permits adjustment of the distance by which said combination slide guide and pivot pin member extends through said vertical stile and into said sash balance assembly.

4. The window assembly of claim 1 wherein said unitary body is plastic and said combination slide guide and pivot pin member is metal.

5. The window assembly of claim 1 wherein said first and second arms of said slide guide means are at least partially beveled to facilitate rotational movement of said cross-bar in said guide rail.

6. A corner assembly constructed to be installed inside a bottom corner of a window sash frame of a window assembly having a vertical jamb with a channel-shaped guide rail opening toward a vertical stile of said window sash frame, said channel-shaped guide rail having opposed inwardly directed flanges defining an opening therebetween, and a sash balance assembly located within said guide rail, said vertical stile including a passage at a bottom corner thereof aligned with said guide rail opening, said corner assembly comprising a corner member; and a combination slide guide and pivot pin member constructed to cooperate with said corner member, said corner assembly being constructed to be installed in said bottom corner of said window sash frame, said corner member comprising a unitary body having a bottom end and a passageway through said bottom end opening toward an upper end of said body, and at least one ledge spaced above said bottom end;

said unitary body having a longitudinal opening communicating with said at least one ledge and adapted to receive said combination slide guide and pivot pin member therethrough so that said combination slide guide and pivot pin member is supported on said at least one ledge;

said combination slide guide and pivot pin member being elongated and comprising a first end;

a second end, disposed opposite said first end, engaging said sash balance assembly and functioning as a pivot pin; and slide guide means, disposed between said first and second ends, for engaging said flanges to retain said window sash frame and said guide rail in substantially parallel relationship during sliding movement of said window sash frame relative to said guide rail, said slide guide means comprising a first arm disposed on a first side of said combination slide guide and pivot pin member and a second arm, aligned with said first arm, disposed on a second side of said combination slide guide and pivot pin member, said first and second arms forming a cross-bar; and wherein said corner assembly at least partially forms said bottom corner of said window sash frame and facilitates sliding of said window sash frame substantially parallel to said guide rail and pivoting of said window sash frame about said sash balance assembly.

7. The corner assembly of claim 6 wherein said second end of said combination slide guide and pivot pin member comprises a slot for engaging a corresponding receptacle located in said sash balance assembly.

8. The corner assembly of claim 6 wherein said bottom corner further comprises an elongated opening and wherein a screw hole is disposed vertically through said combination slide guide and pivot pin member such that a screw inserted through said elongated opening and passing through said screw hole fixes said corner assembly in said bottom corner and permits adjustment of the distance by which said combination slide guide and pivot pin member extends through said vertical stile and into said sash balance assembly.

9. The corner assembly of claim 6 wherein said unitary body is plastic and said combination slide guide and pivot pin member is metal.

10. The corner assembly of claim 6 wherein said first and second arms of said slide guide means are at least partially beveled to facilitate rotational movement of said cross-bar in said guide rail.

* * * * *